US006042517A

United States Patent [19]

Gunther et al.

[11] Patent Number: 6,042,517

[45] Date of Patent: Mar. 28, 2000

[54] BICYCLE TRAINER MAGNETIC RESISTANCE DEVICE

[75] Inventors: John A. Gunther, Redwood City; Mark S. deRoche, Hermosa Beach, both of Calif.

[73] Assignee: Bell Sports, Inc., San Jose, Calif.

[21] Appl. No.: 09/151,393

[22] Filed: Sep. 10, 1998

[51] Int. Cl.[7] ..... A63B 22/06

[52] U.S. Cl. ..... 482/57; 482/60; 482/61; 482/63; 482/903; 188/161; 188/164

[58] Field of Search ..... 482/57, 61, 63, 482/60, 62, 903; 188/161, 163, 158, 164, 267

[56] References Cited

U.S. PATENT DOCUMENTS 5,855,256 1/1999 Kuwahara ..... 188/164

*Primary Examiner*—Richard J. Apley
*Assistant Examiner*—Tam Nguyen
*Attorney, Agent, or Firm*—Robert O. Guillot

[57] ABSTRACT

A magnetic resistive device that is suitable for use with a bicycle trainer including a rotatable shaft having a magnetic resistive force member engaged to an end thereof. In the preferred embodiment the magnetic resistive force member includes a cylindrical outer surface. A plurality of magnets are disposed on one side of said magnetic resistive force member, preferably in alternating polarity. Magnetic fields generated between adjacent magnets create eddy currents within the magnetic resistive force member to create a resistive force against the rotation of the magnetic resistive force member. In the preferred embodiment, the magnets are disposed outside of the cylindrical magnetic resistive force member, and the magnets are movable away from the magnetic resistive force member to reduce the force induced therewithin.

16 Claims, 4 Drawing Sheets

BICYCLE TRAINER MAGNETIC RESISTANCE DEVICE

BACKGROUND OF THE INVENTION

1. Field of the Invention

The present invention relates generally to resistance devices for bicycle trainers, and more particularly to resistance devices that utilize a magnetic force to provide resistive forces.

2. Description of the Prior Art

Bicycle trainers have been known and utilized for many years. For instance, as disclosed in U.S. Pat. No. 4,768,782, entitled: Bicycle Exercising Apparatus, issued Sep. 6, 1988 to James R. Blackburn, a trainer is utilized to support a user's bicycle, typically the rear wheel, to provide a stationary exercise device. The rear wheel of the bicycle rotates upon a roller, and the trainer includes a resistance device that applies a resistive force to the rotation of the roller, thereby impeding the rotation of the rear wheel of the bicycle and providing exercise to the user. The trainer described in the '782 patent discloses a wind cage resistance device, however other types of resistance devices, specifically magnetic resistance devices are well known.

U.S. Pat. No. 4,826,150, reissued as reissue patent Re 34,479, entitled: Resistance Applying Means for Exercising Apparatus, reissued Dec. 14, 1993 to Chihiro Minoura, describes such a magnetic resistance device. In the '479 magnetic resistance device, a rotating disk is surrounded by two sets of permanent magnets. A fixed set of permanent magnets is positioned on one side of the rotating disk, and a movable set of permanent magnets is disposed on the other side of the rotating disk. Magnetic fields between the magnets on each side of the disk cause eddy currents within the rotating disk which inhibit the rotation of the disk. The magnetic forces are made adjustable by adjusting the location of the movable magnet set, relative to the fixed magnet set, such that the strength of the magnetic field between the magnets is altered. Alteration of the strength of the magnetic field creates an alteration in the magnetic resistance force.

The present invention includes a different orientation of magnets around a different rotating member, it includes a different way of applying the resistive force to the rotating member and a different way of adjusting the resistance force.

SUMMARY OF THE INVENTION

A magnetic resistive device that is suitable for use with a bicycle trainer, including a rotatable shaft having a magnetic resistive force member engaged to an end thereof. In the preferred embodiment the magnetic resistive force member includes a cylindrical outer surface. A plurality of magnets are disposed on one side of said magnetic resistive force member preferably in alternating polarity. Magnetic fields generated between adjacent magnets create eddy currents within the magnetic resistive force member to create a resistive force against the rotation of the magnetic resistive force member. In the preferred embodiment, the magnets are disposed outside of the cylindrical magnetic resistive force member, and the magnets are movable away from the magnetic resistive force member to reduce the force induced therewithin.

It is an advantage of the present invention that provides a magnetic resistive device for a trainer that is easy to manufacture.

It is another advantage of the present invention that it is easy for the user to operate.

It is a further advantage of the present invention that it provides an effective resistive force for the user of a trainer.

These and other features and advantages of the present invention will no doubt become apparent to those of ordinary skill in the art upon reviewing the following detailed description which makes reference to the figures of the drawing.

IN THE DRAWINGS

DETAILED DESCRIPTION OF THE PREFERRED EMBODIMENTS

Figure 1:
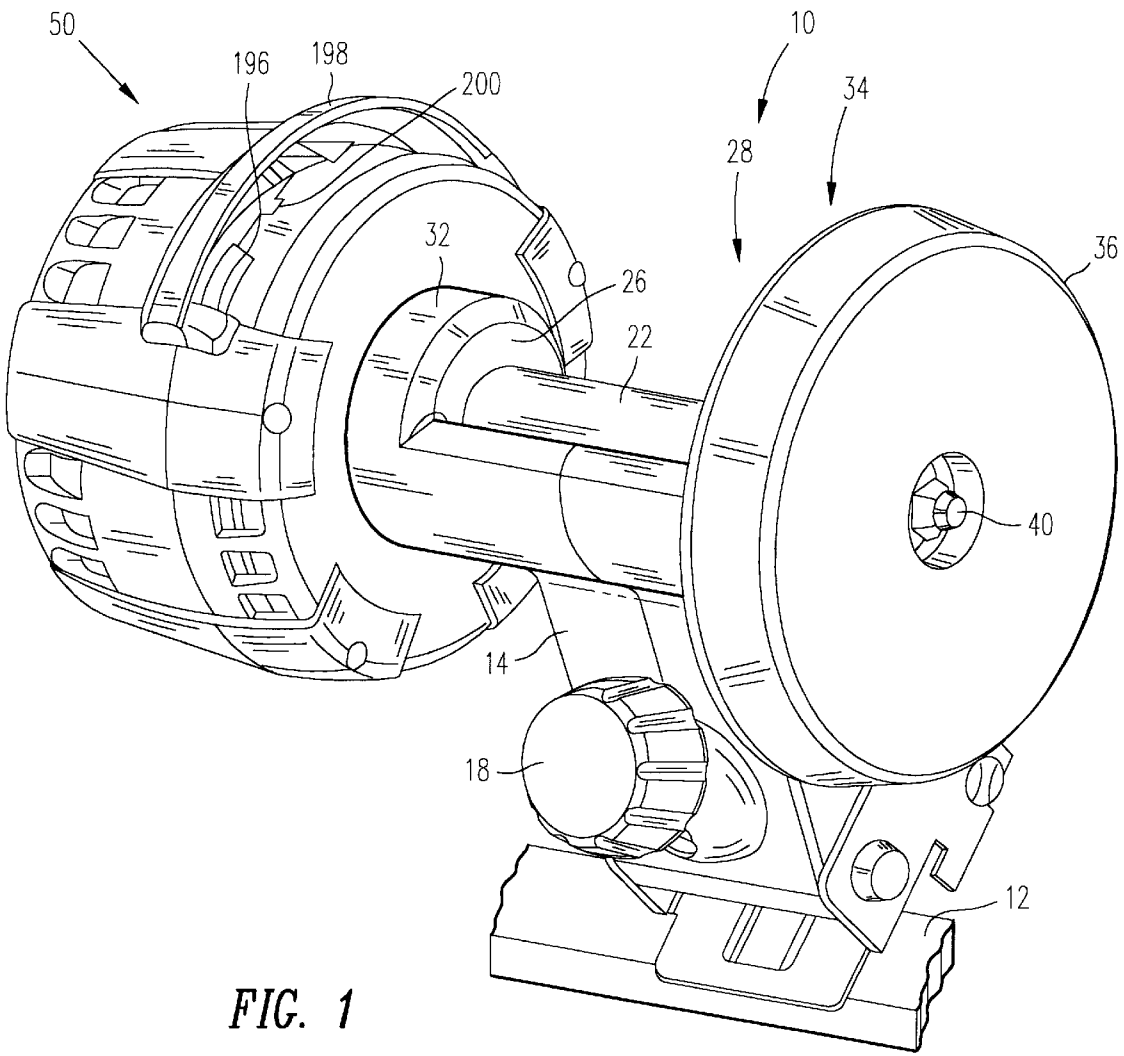
FIG. 1 is a perspective view of the magnetic resistance device of the present invention.

The magnetic resistance device 10 of the present invention is generally depicted in FIG. 1. and is designed to be installed on a bicycle trainer frame 12, such that the rear wheel of the bicycle (not shown) makes rotational contact with the roller 22 of the device. The internal components of the device 10 are depicted in FIGS. 2, 3 and 4, whereby a full description of the present invention is provided.

As depicted in FIG. 1, the magnetic resistance device 10 includes a yoke assembly 14 that is mounted to a trainer 12, and the orientation of the yoke assembly 14 on the is controlled by an adjustment nut 18 in a well known manner. The upper face of the yoke includes a bicycle wheel engagement roller 22 that is supported by two bearings 26 and 28 (not shown) disposed within bearing housing end portions 32 and 34 (not shown) of the yoke assembly 14. A flywheel 36 is engaged by a threaded nut 40 to one extended end of the roller 22. A magnetic resistance unit 50 is engaged to the end bearing housing 32 of the yoke 14, and a rotating end portion 78 of the roller 22 extends within the magnetic resistance unit 50, as is discussed in detail herebelow with the aid of FIGS. 2 and 3.

Figure 2:
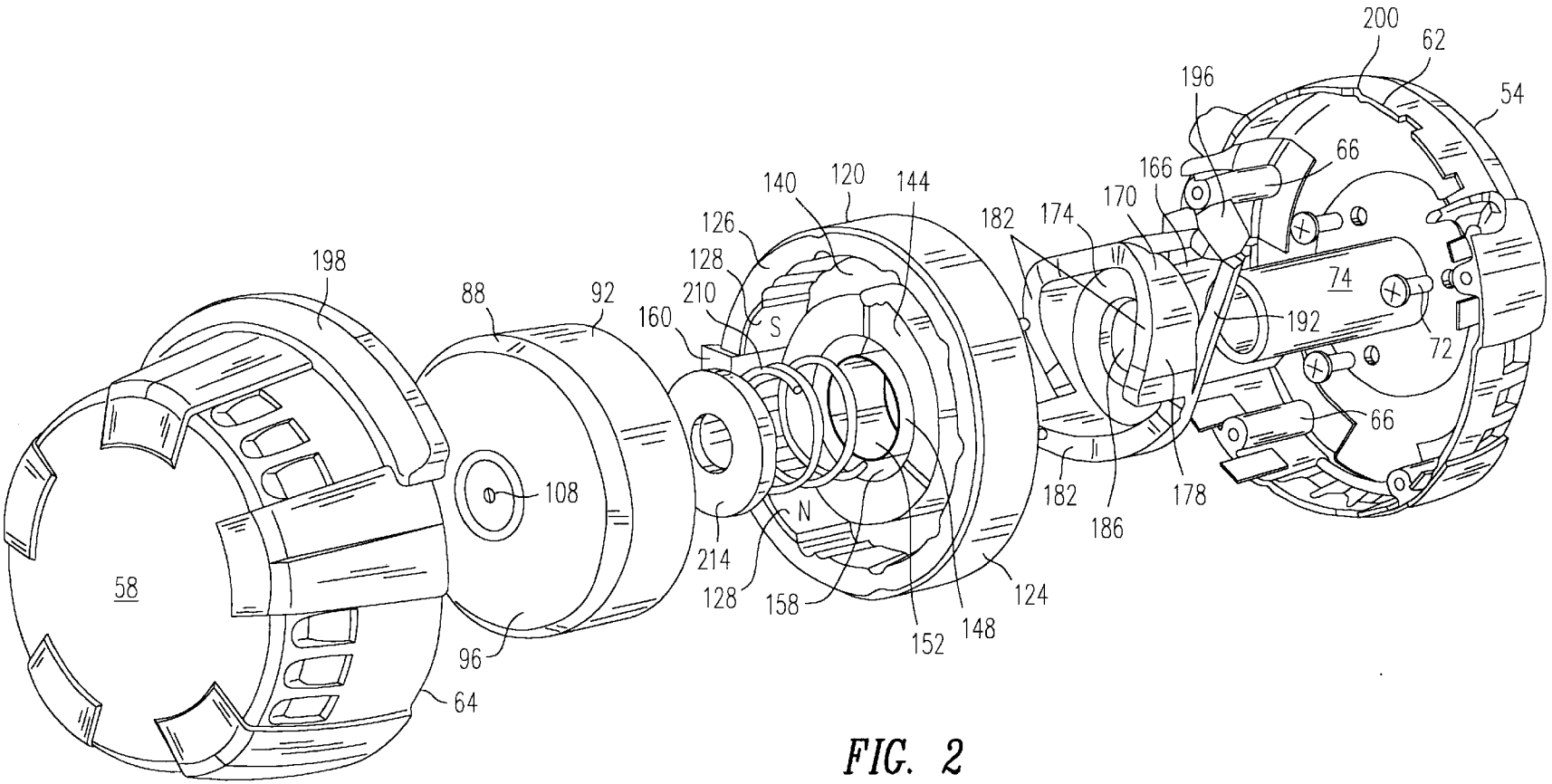
FIG. 2 is an assembly drawing, in perspective view, of the magnetic resistance unit of the present invention.
Figure 3:
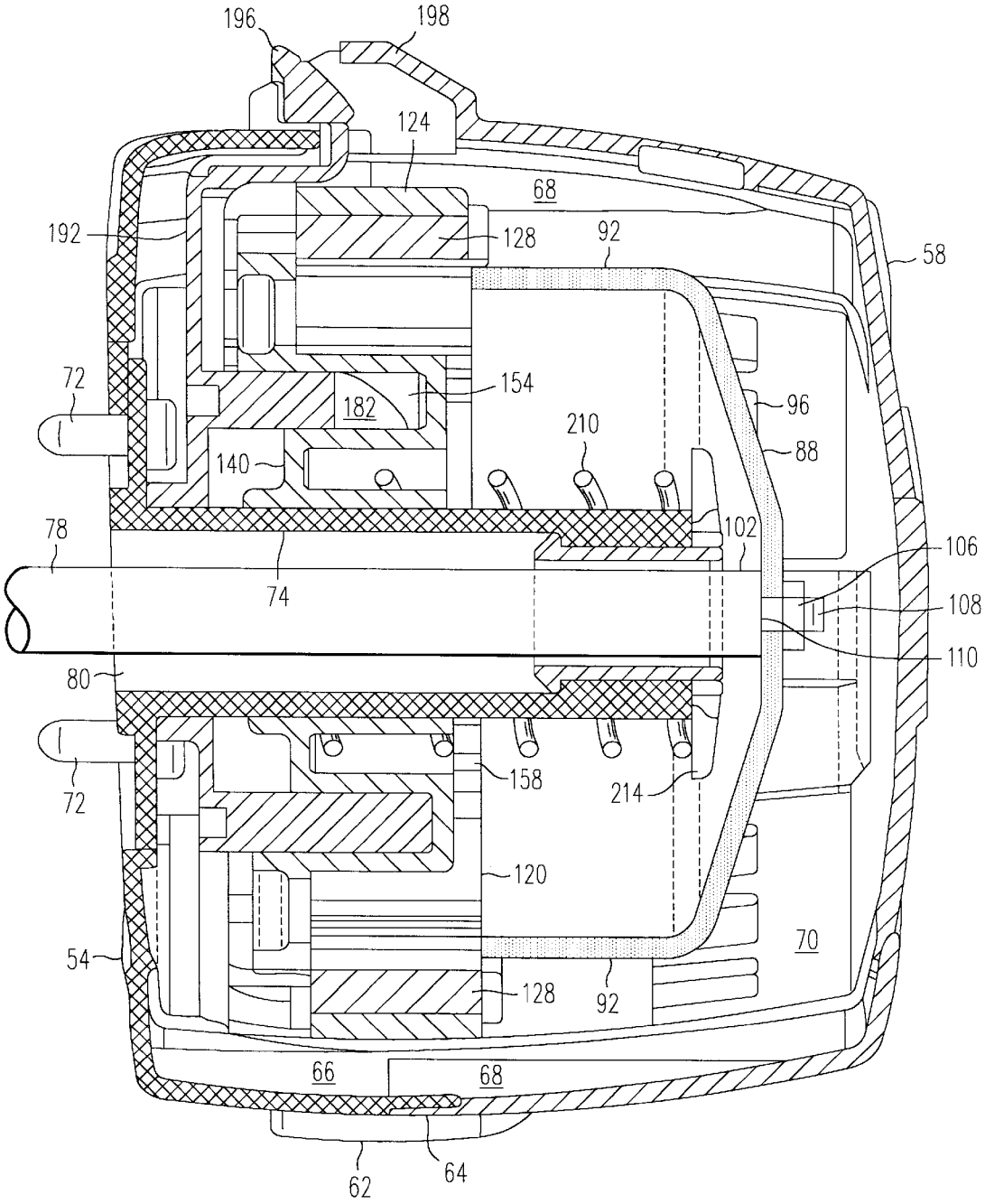
FIG. 3 is a side cross-sectional view of the magnetic resistance unit of the present invention.

FIG. 2 is an assembly drawing depicting internal components of the magnetic resistance unit 50, and FIG. 3 is a side cross-sectional view of the magnetic resistance unit 50. As depicted in FIGS. 2 and 3, the unit 50 includes an inboard housing 54 and an outboard housing 58 that are engagable to each other at edge portions 62 and 64 respectively utilizing threaded screws (not shown) that project outwardly through support posts 66 into threaded screw receiving sockets 68 formed in the inner surface 70 of the outboard housing 58. The inner housing 54 is fixedly engaged to the non-rotating yoke bearing housing 32 utilizing screws 72. A non-rotating, hollow support cylinder 74 projects outwardly from the fixed inner housing 54. The rotating end portion 78 of the roller 22 projects into the bore 80 of the hollow support cylinder 74, as is best seen in FIG. 3. A cup-shaped rotor member 88, having parallel cylindrical sidewalls 92 and a generally cone-shaped base 96, is fixedly engaged to the outer end 102 of the extending shaft 78 utilizing a threaded nut 106 which is threadably engaged to an extending threaded end 108 of the shaft end 102 that passes through a bore 110 formed through the center of the rotor base 96. The cup-shaped rotor 88 therefore rotates when the shaft 78 rotates.

Figure 4:
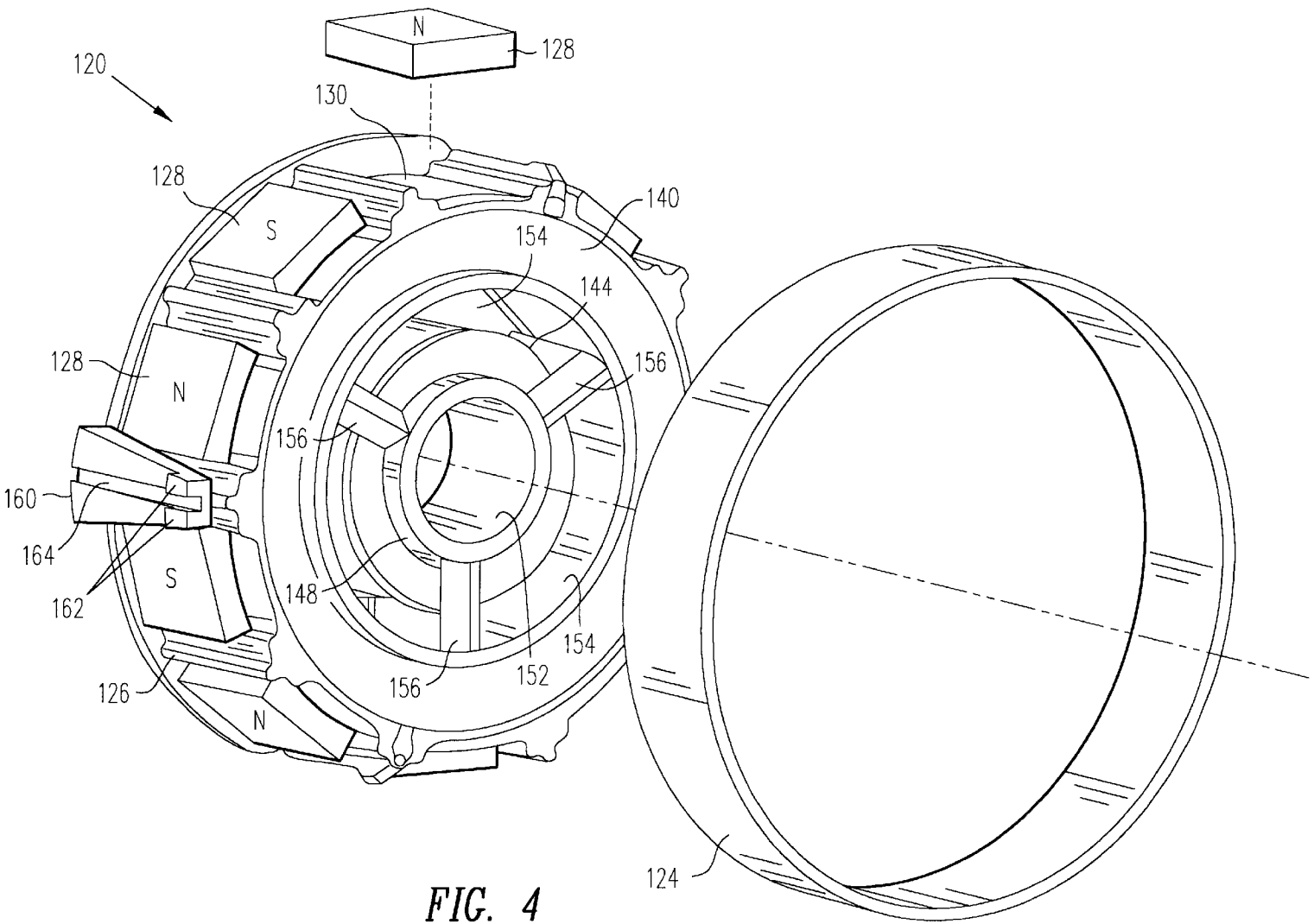
FIG. 4 is an assembly drawing, in perspective view, of the magnet retaining assembly portion of the present invention.

A magnet retainer assembly 120 is engaged within the housing 54, and an assembly drawing of the magnet retainer assembly 120 is presented in FIG. 4. The assembly 120 includes an outer, cylindrical magnet retaining ring 124 and an inner ring shaped-magnet holding ring 126 having a plurality of fixed magnets 128 disposed therewithin. The magnets 128 are disposed with alternate north and south polarities within magnet holding slots 130 formed in the magnet holding ring 126, and the outer magnet retaining ring 124 fits over the magnets 128 to hold them within the slots 130. The magnet retaining ring 124 is preferably composed of a magnetic material such as steel, to shape and strengthen the magnetic field that exists between the adjacent magnets 128. The inner diameter of the holding ring 126 is larger than the outer diameter of the cylindrical sidewalls 92 of the rotor 88, such that the sidewalls 92 of the rotor 88 may be disposed within the holding ring 126.

The assembly 120 includes an inner base portion 140 having a cam engaging section 144 and a cylindrical center portion 148 having a central bore 152 formed therethrough. The bore 152 of the cylindrical center portion 148 is sized to slidably engage the outer surface of the central support cylinder 74. It is therefore to be understood that the ring assembly 120 is slidably engagable upon the support cylinder 74, whereas the rotor 88 is rotatably fixed to the end 102 of the rotatable shaft 78. The cam engaging section 144 includes a cylindrical slot 154 having three radially projecting camming ribs 156 formed therein. The ribs 156 project radially outwardly from the cylindrical center portion 148, and they interact with camming surfaces 182 of a camming device 170, as is described in detail herebelow. A cylindrical spring holding slot 158 surrounds the cylindrical center portion 148 to provide a recess for housing a return spring 210, as is discussed more fully herebelow.

As is best seen in FIG. 4, a rotation prevention arm 160 projects radially outwardly from the ring assembly 120. The arm 160 includes two radially projecting fingers 162 having a rib engagement slot 164 formed therebetween. The fingers 162 and slot 164 act to engage an inwardly projecting rib 166 formed in the inner surface of the inboard housing 54. Thus, the arm 160, with its fingers 162 and slot 164 acts to engage the inwardly projecting rib 166 to prevent rotational motion of the ring assembly 120, while allowing inward and outward motion of the ring assembly 120.

A user rotatable camming device 170 is disposed within the inner housing 54. The camming device 170 includes a base portion 174 and generally cylindrical sidewall portions 178 which have three spiraling outward camming surfaces 182 cut therein. The base 174 has a central bore 186 formed therethrough for passage of the support cylinder 74 therethrough. A lever member 192 projects radially from the camming assembly 170 and terminates with a user operable adjustment lever end 196 that is slidably disposed on the outer surface of the inner housing 54. Adjustment notches 200 are formed in the edge 62 of the inner housing 54 for interaction with portions of the lever end 196 to act as detents in the slidable movement of the lever end 196. A lever dust cover 198 is formed on the outer surface of the outboard housing 58 to substantially prevent dirt from entering into the device proximate the lever end 196.

It is therefore to be understood that when the lever end 196 is slidably, rotatably moved about the edge 62 of the inner housing 54 into the various detents 200 that the lever member 192 is likewise rotated. When the lever member 192 is rotated it causes the camming assembly 170 to rotate, such that the camming ribs 116 interact with the spiral camming surfaces 182 of the camming assembly 170. Because the ring assembly 120 does not rotate as described hereinabove the ring assembly 120 is caused to move laterally outwardly on the support cylinder 74 by the action of the rotating camming surfaces 182 against the camming ribs 156 within the cam engaging section 144 of the ring assembly 120. As the ring assembly 120 moves outwardly, the magnet holding ring 126 encloses the cylindrical sidewalls 92 of the rotor 88 to a greater and greater degree. The alternating north and south magnets 128 within the holding outer ring 126 become disposed about the outer surface of the cylindrical sidewalls 92 of the rotor 88. The rotor 88 is composed of an electrically conductive, non-magnetic material, such as aluminum, copper or alloys thereof, and the magnetic field generated between the alternating north and south magnets 128 disposed outside of the external surface of the sidewall 92 causes a electromagnetic braking effect. That is, eddy currents are created within the rotating sidewalls 92, and they act to apply a force which inhibits the rotation of the rotor 88, as is well known to those skilled in the art. Thus, the greater extent to which the sidewalls 92 of the rotor 88 are disposed within the magnet retainer assembly 120, the greater will be the rotation resistance force created in the sidewalls 92 of the rotor 88. The rotor 88 thus acts as a magnetic resistive force member through which the resistive force created by the magnets 128 is conveyed to the rotating shaft 78.

A magnet assembly return spring 210 is disposed within the spring housing slot 158 to project outwardly of the magnet assembly 120, and a spring cap 214 is fixedly engaged within the outer end of the Support cylinder 74 to provide an outer spring force resistance surface. The inner end of the spring 210 within the housing 158 presses against the ring assembly 120 to urge it inwardly against the camming surfaces 182 of the device member 170. Thus, when the user operated lever end 196 is moved to cause the magnet holding assembly 120 to move inwardly (thereby reducing the magnetic resistive force), the spring force pushes against the assembly 120 to urge the assembly 120 inwardly into the inboard housing 54. As the assembly 120 moves inwardly, the outer ends of the camming surface 182 project into the slot 154 within the assembly 120.

While the present invention has been shown and described with regard to certain preferred embodiments, it is to be understood that those skilled in the art will conceive of certain alterations and modifications therein. It is therefore to be understood that the inventors intend the following claims to cover all such alterations and modifications that nevertheless include the true spirit and scope of the invention.

What we claim is:

1. A magnetic resistance device comprising:

a rotatable shaft;

a fixed housing;

a magnetic resistive force member having a cylindrical surface and being engaged to said rotatable shaft to rotate therewith;

a plurality of magnets being engaged within said housing and disposed proximate to and radially outward of said surface on one side of said magnetic resistive force member;

said magnets being disposed in alternating polarity around said magnetic resistive force member, and wherein magnetic fields are formed between said magnets to create eddy currents within said magnetic resistive force member.

2. A magnetic resistance device comprising:

a rotatable shaft;

a fixed housing;

a magnetic resistive force member being engaged to said rotatable shaft to rotate therewith;

a plurality of magnets being engaged within said housing, wherein each of said magnets are disposed on a movable magnet holding member and disposed on one side of said magnetic resistive force member;

said magnets being disposed in alternating polarity around said magnetic resistive force member, and wherein magnetic fields are formed between said magnets to create eddy currents within said magnetic resistive force member.

3. A device as described in claim 2 wherein said magnet holding member holds said magnets in a ring shaped orientation.

4. A device as described in claim 3 wherein said magnet holding member is generally cylindrically shaped and has a diameter, and wherein said magnetic resistive force member includes a cylindrical surface having a diameter, and wherein said diameter of said cylindrical surface is less than the diameter of said magnet holding member.

5. A device as described in claim 2 wherein said magnet holding member is movable in a lateral direction relative to said magnet resistive force member.

6. A device as described in claim 5 further including a cam member, and wherein said magnet holding member includes a cam engaging surface, and wherein movement of said cam member in contact with said cam engaging surface causes said lateral direction movement of said magnet holding member.

7. A magnetic resistance device comprising:

a rotatable shaft;

a fixed housing;

a magnetic resistive force member having a cylindrical surface and being engaged to said rotatable shaft to rotate therewith;

a plurality of magnets being engaged within a movable magnet holding member disposed within said housing, said magnets being disposed on an outer side of said cylindrical surface of said magnetic resistive force member;

a cam member, and wherein said magnet holding member includes a cam engaging surface, and wherein movement of said cam member in contact with said cam engaging surface causes a lateral direction movement of said magnet holding member;

said magnets being disposed in alternating polarity around said magnetic resistive force member, and wherein magnetic fields are formed between said magnets to create eddy currents within said magnetic resistive force member.

8. A device as described in claim 7 wherein said magnet holding member holds said magnets in a ring shaped orientation.

9. A device as described in claim 8 wherein said magnet holding member is generally cylindrically shaped and has a diameter, and wherein said magnetic resistive force member includes a cylindrical surface having a diameter, and wherein said diameter of said cylindrical surface is less than the diameter of said magnet holding member.

10. A bicycle trainer, comprising:

a frame;

a magnetic resistive device being engaged to said frame; said magnetic resistance device including a yoke device that rotatably supports a roller member for engagement with a bicycle wheel; said roller having a first outboard end supporting a flywheel and a second end that is engaged to a magnetic resistive device; said magnetic resistive device including:

a rotatable shaft;

a fixed housing;

a magnetic resistive force member being engaged to said rotatable shaft to rotate therewith;

a plurality of magnets, each said magnet being engaged to a movable magnet holding member within said housing and disposed on one side of said magnetic resistive force member;

said magnets being disposed in alternating polarity around said magnetic resistive force member, and wherein magnetic fields are formed between said magnets to create eddy currents within said magnetic resistive force member.

11. A device as described in claim 10 wherein said magnetic resistive force member includes a cylindrical surface and wherein said magnets are disposed proximate said surface.

12. A device as described in claim 11 wherein said magnets are disposed radially outward of said surface.

13. A device as described in claim 10 wherein said magnet holding member holds said magnets in a ring shaped orientation.

14. A device as described in claim 13 wherein said magnet holding member is generally cylindrically shaped and has a diameter and wherein said magnetic resistive force member includes a cylindrical surface having a diameter, and wherein said diameter of said cylindrical surface is less than the diameter of said magnet holding member.

15. A device as described in claim 10 wherein said magnet holding member is movable in a lateral direction relative to said magnet resistive force member.

16. A device as described in claim 15 further including a cam member, and wherein said magnet holding member includes a cam engaging surface, and wherein movement of said cam member in contact with said cam engaging surface causes said lateral direction movement of said magnet holding member.

* * * * *